US008465625B2

(12) United States Patent
Boehm et al.

(10) Patent No.: US 8,465,625 B2
(45) Date of Patent: Jun. 18, 2013

(54) SECURITY PAPER AND METHOD AND APPARATUS FOR PRODUCING THE SAME

(75) Inventors: Michael Boehm, Kirchheim (DE); Horst Reigl, Miesbach (DE); Theo Burchard, Gmund am Tegernsee (DE)

(73) Assignee: Giesecke & Devrient GmbH, Munich (DE)

( * ) Notice: Subject to any disclaimer, the term of this patent is extended or adjusted under 35 U.S.C. 154(b) by 713 days.

(21) Appl. No.: 10/499,107

(22) PCT Filed: Dec. 17, 2002

(86) PCT No.: PCT/EP02/14417

§ 371 (c)(1),
(2), (4) Date: Apr. 27, 2005

(87) PCT Pub. No.: WO03/054297

PCT Pub. Date: Jul. 3, 2003

(65) Prior Publication Data

US 2005/0224203 A1 Oct. 13, 2005

(30) Foreign Application Priority Data

Dec. 21, 2001 (DE) ..... 101 63 381

(51) Int. Cl.
*D21H 21/40* (2006.01)
*D21H 21/42* (2006.01)

(52) U.S. Cl.
USPC ..... 162/211; 162/110; 162/140; 162/351; 283/72; 283/82; 283/83; 283/85; 283/92; 283/113

(58) Field of Classification Search
USPC ..... 162/140; 283/52.1, 53, 57, 58, 59
See application file for complete search history.

(56) References Cited

U.S. PATENT DOCUMENTS

| | | | | |
|---|---|---|---|---|
| 987,678 | A * | 3/1911 | Howes | 162/126 |
| 1,903,711 | A | 4/1933 | Wendel | |
| 2,532,664 | A * | 12/1950 | Freedman | 281/5 |
| 3,770,943 | A * | 11/1973 | Sill | 235/487 |
| 3,881,987 | A | 5/1975 | Benz | |
| 4,462,866 | A * | 7/1984 | Tooth et al. | 162/103 |
| 4,943,093 | A * | 7/1990 | Melling et al. | 283/83 |
| 5,176,405 | A | 1/1993 | Kaule et al. | |
| 5,265,916 | A | 11/1993 | Coe | |
| 5,405,500 | A | 4/1995 | Knight | |

(Continued)

FOREIGN PATENT DOCUMENTS

| | | |
|---|---|---|
| CA | 2122528 A1 | 11/1994 |
| CA | 2325316 A1 | 3/2001 |

(Continued)

OTHER PUBLICATIONS

Rydholm, "Pulping Processes," Interscience Publishers, 1965, pp. 51-52.*

(Continued)

*Primary Examiner* — Mark Halpern
*Assistant Examiner* — Dennis Cordray
(74) *Attorney, Agent, or Firm* — Rothwell, Figg, Ernst & Manbeck, P.C.

(57) ABSTRACT

A security paper for producing security documents, such as bank notes, identity cards or the like, having at least one opening, whereby the opening is produced during papermaking and does not have a sharp limiting edge in the edge area.

16 Claims, 6 Drawing Sheets

U.S. PATENT DOCUMENTS

| | | | | |
|---|---|---|---|---|
| 5,424,119 | A | 6/1995 | Phillips et al. | |
| 5,465,301 | A * | 11/1995 | Jotcham et al. | 380/54 |
| 5,492,370 | A | 2/1996 | Chatwin et al. | |
| 5,783,275 | A | 7/1998 | Muck et al. | |
| 5,820,971 | A | 10/1998 | Kaule et al. | |
| 5,876,068 | A | 3/1999 | Schneider et al. | |
| 5,944,927 | A | 8/1999 | Seifert | |
| 6,210,777 | B1 | 4/2001 | Vermeulen et al. | |
| 6,355,140 | B1 * | 3/2002 | Murakami et al. | 162/140 |
| 6,428,051 | B1 * | 8/2002 | Herrmann et al. | 283/107 |
| 6,471,248 | B2 | 10/2002 | Hardwick et al. | |
| 6,474,695 | B1 | 11/2002 | Schneider et al. | |
| 6,491,324 | B1 | 12/2002 | Schmitz et al. | |
| 6,508,489 | B2 | 1/2003 | Hermann et al. | |
| 6,545,166 | B2 | 4/2003 | Honma et al. | |
| 6,616,803 | B1 * | 9/2003 | Isherwood et al. | 162/103 |
| 6,686,027 | B1 | 2/2004 | Caporaletti et al. | |
| 6,903,850 | B2 | 6/2005 | Kay et al. | |
| 6,954,293 | B2 | 10/2005 | Heckenkamp et al. | |
| 7,054,042 | B2 | 5/2006 | Holmes et al. | |
| 7,080,041 | B2 * | 7/2006 | Nagel | 705/51 |
| 2005/0211403 | A1 * | 9/2005 | Hard | 162/140 |

FOREIGN PATENT DOCUMENTS

| | | | |
|---|---|---|---|
| EP | 0 013 557 | A | 7/1980 |
| EP | 0059056 | * | 1/1982 |
| EP | 0 229 645 | A | 7/1987 |
| EP | 0 290 875 | A | 11/1988 |
| EP | 0 319 157 | A | 6/1989 |
| EP | 0 625 431 | A | 11/1994 |
| EP | 0 648 616 | A | 4/1995 |
| EP | 0 667 248 | A | 8/1995 |
| EP | 0667248 | A1 * | 8/1995 |
| GB | 1 604 463 | A | 12/1981 |
| GB | 2 311 303 | A | 9/1997 |
| HU | 219 095 | B | 4/1997 |
| HU | 0104929 | | 4/2002 |
| JP | 10237799 | | 9/1998 |
| JP | 2001172897 | | 6/2001 |
| JP | 2001213074 | | 8/2001 |
| KR | 199825249 | | 7/1998 |
| RU | 2135667 | C1 | 8/1999 |
| SU | 178675 | | 1/1966 |
| WO | WO 95/10420 | A | 4/1995 |
| WO | 98/13211 | A1 | 4/1998 |
| WO | 99/04983 | A1 | 2/1999 |
| WO | WO 00/39391 | A1 | 7/2000 |
| WO | 02/00445 | A1 | 1/2002 |
| WO | 02/00446 | A1 | 1/2002 |

OTHER PUBLICATIONS

Smook, Gary A., Handbook of Pulp and Paper Terminology, Angus Wilde Publications, 1990, p. 205.*

English language abstract of EP 0667428, 2006.*

* cited by examiner

SECURITY PAPER AND METHOD AND APPARATUS FOR PRODUCING THE SAME

CROSS-REFERENCE TO RELATED APPLICATION

This application is a National Phase of International Serial No. PCT/EP02/14417, filed Dec. 17, 2002.

FIELD OF THE INVENTION

This invention relates to a security paper for producing security documents, such as bank notes, identity cards or the like, having a through opening, and to a method and apparatus for producing such a security paper. The invention further relates to a value document, such as a bank note, identity card or the like, having a through opening.

DESCRIPTION OF THE BACKGROUND ART

WO 95/10420 describes a value document having a through opening punched thereinto after production thereof, said opening then being sealed on one side with a cover foil protruding beyond the opening on all sides. The cover foil is transparent at least in a partial area, so that upon an attempt to copy the value document the background will be visible and rendered accordingly by the copy machine. This permits forgeries to be easily recognized.

However, said known value document has the disadvantage that the opening produced by punching can likewise be produced by a forger. The color copy of an authentic value document no longer has the transparent area, but said area can subsequently be punched out analogously to the authentic value document and sealed again with a suitable cover foil. Forgeries are therefore difficult to recognize.

SUMMARY OF THE INVENTION

The invention is based on the problem of proposing a security paper and a value document having increased forgery-proofness in comparison with the prior art.

The basic idea of the invention is that by production of a "window opening" during sheet formation, i.e. during papermaking, the edge area of the opening will have characteristic irregularities which are not producible subsequently on the finished paper. The irregularities are expressed by the lack of a sharply cut edge or irregular accumulation of fibers in the edge area, and by individual fibers protruding into the opening. A rough check of this characteristic edge structure is already possible with the naked eye, while an exact check can be done with a magnifying glass.

The inventive edge structure ensures that the opening cannot be produced by subsequently punching a paper sheet. An opening produced in such a way therefore has a similar security value to a watermark produced during papermaking or a security thread embedded during papermaking.

Security paper is normally produced in broad webs with several copies disposed side by side. After completion, the webs are cut into sheets with e.g. 6×9 copies present thereon. Said sheets are printed and then cut into single copies.

If each single copy is to have a through opening, a corresponding number of elements are to be provided on the screen of the paper machine which prevent sheet formation exactly in the surface areas where the opening is needed. If the security paper is to have watermarks in addition, production is done as a rule on so-called "cylinder paper machines" wherein the screen is mounted on a rotating drum. In this case, the opening can be located in the area of the watermark.

The security paper according to the invention has at least one through opening produced during papermaking. To permit this opening to be produced, the screen of the paper machine must be provided with at least one water-impermeable, preferably elastic or movably mounted sealing element per copy. The sealing element prevents sheet formation in this area. To prevent fibers from being deposited on the sealing element during sheet formation, it is preferably formed so high that it protrudes clearly beyond the paper surface. Upon removal of the paper web by the take-off roll covered with pickup felt, however, it must be ensured that the sealing element does not hinder the contact between the moist and still very unstable paper web and the take-off roll, since the paper web will otherwise break in this area. For this reason the sealing element consists according to the invention of a highly elastic material which can be compressed by the take-off roll approximately to the level of the paper surface. Alternatively, the sealing element consists of a movably mounted, preferably rigid plastic or metal element which is lowered approximately to the level of the paper surface or therebelow either by the action of pressure of the take-off roll itself or by electronic control upon contact with the take-off roll.

Further possibilities for producing the opening are sealing the screen surface with a plastic material, such as a lacquer, whereby the plastic material is likewise to be understood as a sealing element according to the invention. Alternatively, rigid sealing elements in the size of the opening to be produced can be applied (e.g. soldered) to the screen surface, said elements having a thickness considerably greater than the thickness of the paper web.

In some cases it may be helpful to provide further drainage-reducing structures in the edge area of the sealing elements for producing a kind of rated breaking point in the paper web. This is because the cotton fibers principally used for security papers have the tendency to settle over the sealing elements unchecked, thereby preventing hole formation or at least making it more difficult.

The freeness-inhibiting structures can be for example special embossings in the papermaking screen, additional screen elements, possibly with a different mesh width from the original papermaking screen, or plastic structures. In principle, any conceivable structures can be used that delay freeness and thus form a bright corona around the opening to be produced. In some cases it is already sufficient to use only the freeness-inhibiting structures. For example, an annular embossing can be so designed that the inventive hole is produced upon removal of the paper web from the screen.

The paper web lying on the pickup felt and having the openings formed due to the sealing elements is then further processed into a self-supporting paper web in further method steps, such as calendering, sizing and drying. To improve hole formation one can, in addition or as an alternative to the freeness-inhibiting structures additionally used during papermaking, remove fibers protruding into the desired opening after paper formation, e.g. by punching or cutting, the fibers being removed only to the extent that the hole edge produced by papermaking is not destroyed or actually removed completely. For example, if a circular hole is to be produced but a fine web of fibers settles irregularly over the hole, the disturbing fiber web can be removed with a circular punching mold whose diameter is smaller than the desired hole. Then a hole edge produced by papermaking is always recognizable, possibly only in a partial area of the hole edge. The inventive security paper therefore has at least one opening whose edges are at least partly irregular and show a character similar to hand-made paper, unlike the sharp edges of a punched or cut opening.

The fibrous, irregular edge of the openings is visually recognizable and therefore serves as an authenticity feature that is easy to check. If forgery-proofness is to be increased further, at least one watermark can be formed in addition in the surroundings of the opening, or the opening produced in a watermark area. Depending on the type of watermark to be produced, this requires different measures on the papermaking screen. For producing two-level watermarks with a strong light/dark effect, metal wires or metal moldings (so-called electrotypes) are soldered to the papermaking screen. For producing multi-level watermarks, however, a three-dimensional relief is embossed into the papermaking screen. Combinations of screen embossing and other measures preventing sheet formation, such as electrotypes or the application of sealing compound, are also used in watermark production. The thereby obtained light/dark modulation in the security paper in the direct surroundings of the opening confronts the forger with hardly solvable problems.

The form of the watermark can be selected here so that it is meaningfully related to the outline contour of the opening, or the opening and the surrounding watermark form a connected motif.

The papermaking screen is preferably a cylinder. Since the sealing element is either elastic or at least movably mounted, however, the invention can also be readily used in fourdrinier paper machines.

The inventive goal of preventing or greatly hindering forgeries of value documents with an opening can also be obtained by producing a relatively large, thin area in the security paper by corresponding screen embossing and/or freeness hindrance with electrotypes and providing the inventive opening in said area, whereby the thin paper area protrudes beyond the opening at least on one side, preferably on all sides, so that upon transmissive viewing of the security paper the thin paper area stands out in contrast from the rest of the surrounding paper web. The opening can in this case be produced during papermaking, as described above. Subsequent punching or cutting, in particular laser cutting, of the security paper is likewise possible, however, since a forgery can be recognized by the lack of a thinner paper area in the immediate surroundings of the opening.

The thinner area in the security paper can have a uniform thickness or else be formed as a multi-level watermark. If the security paper consists of two-ply paper, it is also possible to provide one layer, preferably the thicker one, with a hole which is then covered by the second paper layer. In said second paper layer the inventive opening is finally incorporated subsequently, its dimensions being smaller than those of the hole produced in the first paper layer.

In the case of two-ply paper consisting of a thinner and a thicker layer, the inventive hole can of course also be located in the thinner layer.

The inventive opening can be composed of several partial openings separated from each other by paper bars. The partial openings can have any desired outline contours and are preferably used as an additional design element. For producing the particular partial openings all the above-mentioned methods for producing the inventive opening can be used analogously.

In accordance with a preferred embodiment of the invention, the opening is provided with a security element protruding beyond the opening at least on one surface of the security paper after production thereof. Said security element can consist of a simple transparent plastic film or else be executed as a multilayer security element having one or more visually and/or machine testable security features.

Said security feature can involve diffraction structures, such as reflection or transmission holograms, reflectively observable grating structures or volume holograms, thin-film elements or filter elements, such as polarizing filters or interference filters. Filter elements have in particular the advantage that they can be used for checking further security features provided on or in the security paper by making the opening congruent with said further security feature by folding the security paper. However, the security element disposed in the area of the opening can also carry a simple print or a moiré pattern as a security feature. The inks used for said print can have a substance with optically variable, luminescent, electrically conductive or magnetic properties. The optically variable substances can be in particular interference layer pigments or liquid crystal pigments.

The security feature can further consist of a metallization, whereby several different-colored metals can also be used. Rasterization of the metal layers or reflecting layers of diffraction structures is also possible. Any desired semitransparent layers can of course also be used. The security feature can furthermore consist of a perforation or a lens structure.

A sufficiently large area of the security element is preferably kept completely transparent to permit easy recognition of forgeries produced by a color copier. A copy does not have said transparent area.

The security element can be formed for example as a self-supporting label or embossed foil element protruding beyond the opening by a certain measure on all sides. With this solution it is advantageous if the security paper has a depression in the area of the bearing surface of the security element, so that the security paper has a continuous surface in said area. In extreme cases the security element can cover the security paper or value document all over. This solution can also be provided on both sides of the security paper or value document.

The depression can be produced by compressing the security paper in this area before application of the security element. However, it is particularly simple to already produce the depression during papermaking by hindering sheet formation in the direct surroundings of the opening and thus forming a thinner place in the paper.

In accordance with a further embodiment, the security element can also be formed in a strip shape and extend over the total length or width of the security paper. This variant makes sense particularly when the security element is applied to the as yet uncut security paper in endless form. In this case the security element can be laminated on the security paper by a hot stamping technique in a continuous process.

The outline contour of the security element can be chosen at will. It can for example match the contour of the opening or be meaningfully related to a watermark surrounding the opening. Security element and watermark can also form a connected motif. Thus, the security element or opening and the watermark can together convey the impression of a stylized sun if the security element or opening is of circular form and the watermark areas are disposed radially around the opening.

The same applies analogously to the security feature applied in the area of the security element. For example, the security element can carry a print repeated in form of the watermark as a security feature.

The opening and/or the security element can be circular, oval, rectangular, trapeziform or also star-shaped. Any other outline contour is of course also possible.

If both sides of the opening are provided with a security element, the same, or the same type of, security element can be applied to both sides, or else different ones. The following combinations are preferred:

| Side 1 | Side 2 |
|---|---|
| Self-supporting plastic film, possibly with one or more security features; in label or strip form or all over | Self-supporting plastic film, possibly with one or more security features; in label or strip form or all over |
| Self-supporting plastic film, possibly with one or more security features; in label or strip form or all-over | Embossed foil element; in label or strip form or all-over |
| Self-supporting plastic film, possibly with one or more security features in label or strip form or all over | Coating or print consisting of a resin or a printing ink containing visually and/or machine testable substances (e.g. liquid crystal or interference layer pigments, luminescent substances); in label or strip form or all over |

The inventive security paper can be further processed into any value documents, such as bank notes, shares, identity cards, credit cards, security labels, coupons, etc. It can also be used in the area of product protection for protecting any goods from forgery.

BRIEF DESCRIPTION OF THE DRAWINGS

Further advantages and embodiments will be explained with reference to the figures, in which.

DETAILED DESCRIPTION OF THE INVENTION

Figure 1:
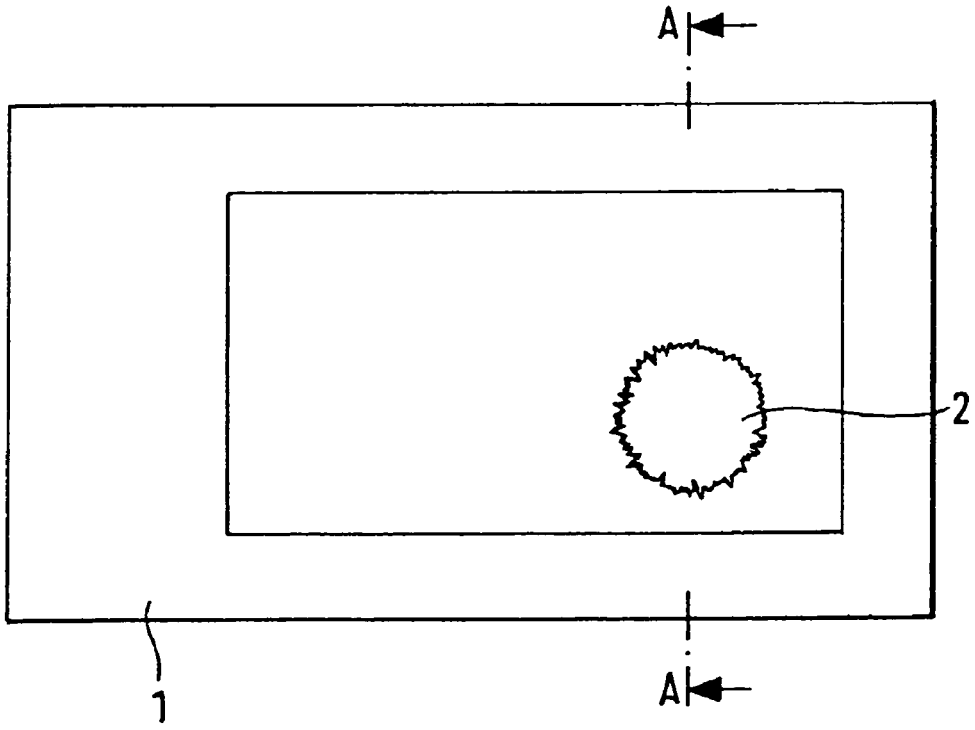
FIG. 1 shows an inventive value document in a plan view.

FIG. 1 shows an inventive value document in a plan view. The shown example involves a bank note 1. Said bank note 1 has a through opening 2. Said opening was produced during production of the security paper used for the bank note 1 and therefore has a fibrous, irregular edge 14. Said edge 14 arises during sheet formation of the paper used for the bank note and cannot be produced by subsequently punching or cutting the paper.

Figure 2:
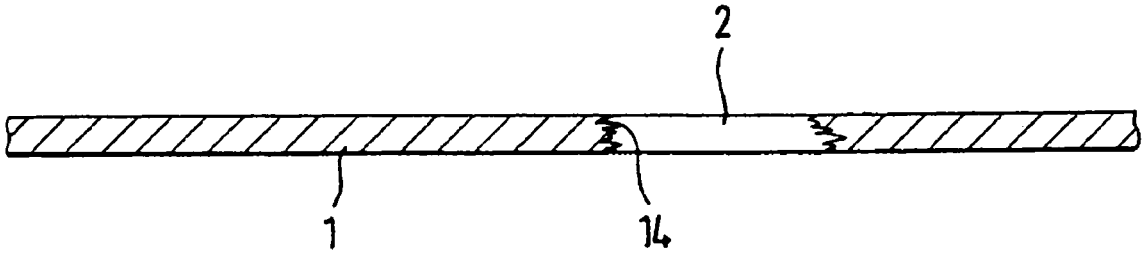
FIG. 2 shows a section through said value document along A-A.

FIG. 2 shows the bank note 1 in cross section along line A-A. This makes it clear that the opening 2 is a through opening.

Figure 3:
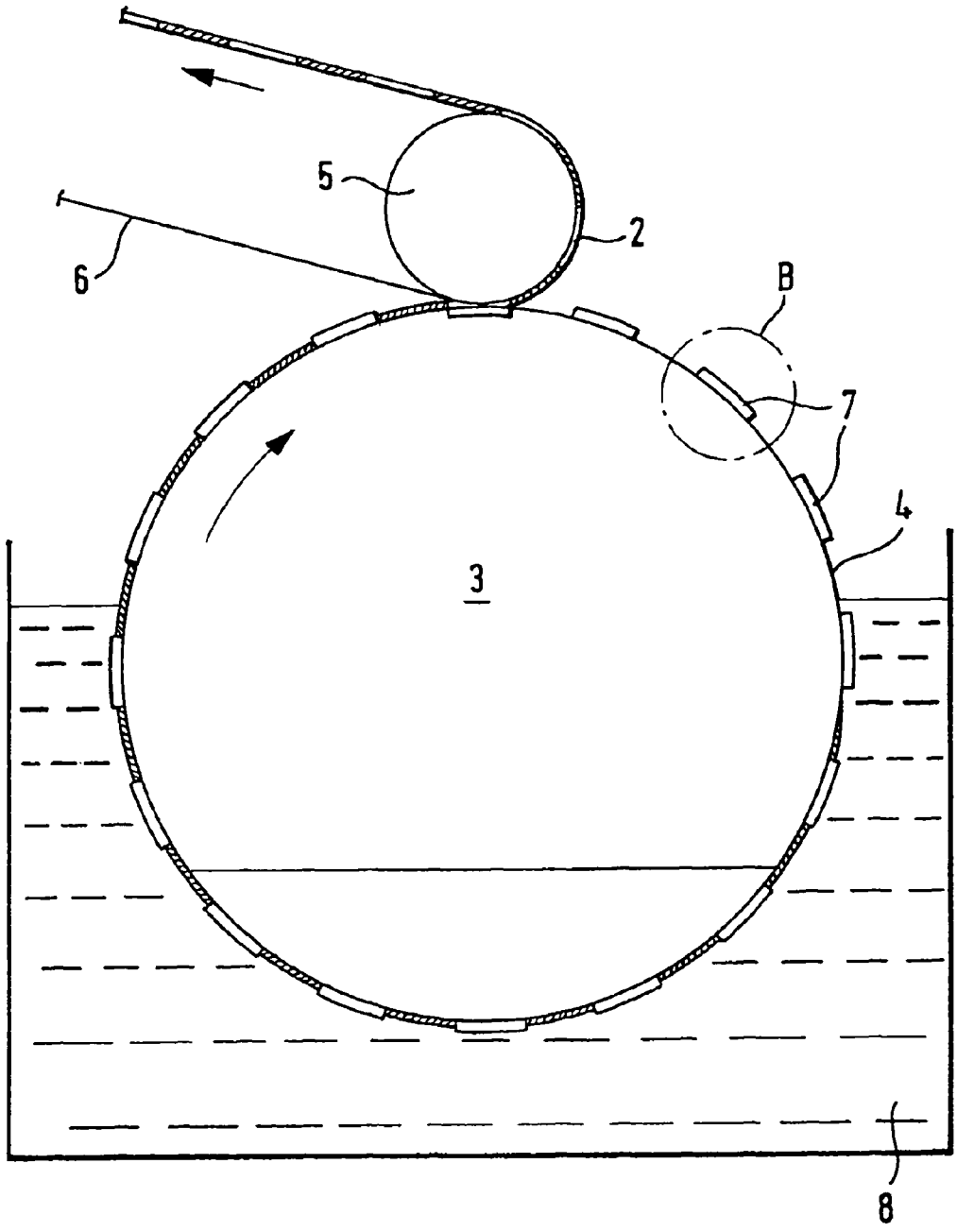
FIG. 3 shows an inventive apparatus for producing the inventive security paper.

FIG. 3 shows the schematic representation of a cylinder paper machine 3 as is preferably used for producing the inventive security paper 10. The apparatus 3 consists essentially of the papermaking screen 4 and the take-off roll 5 on which the pickup felt 6 is mounted.

The papermaking screen 4 has sealing elements 7 which prevent sheet formation when the papermaking screen is dipped into the paper pulp 8 and thus produce the inventive openings 2. The sealing elements 7 are so formed that they do not hinder removal of the paper web 10 in the area of the take-off roll 5. Since at this time the paper web 10 is still very unstable and has low strength, a contact without tension must be ensured between the paper web 10 and the pickup felt 6.

Figure 4:
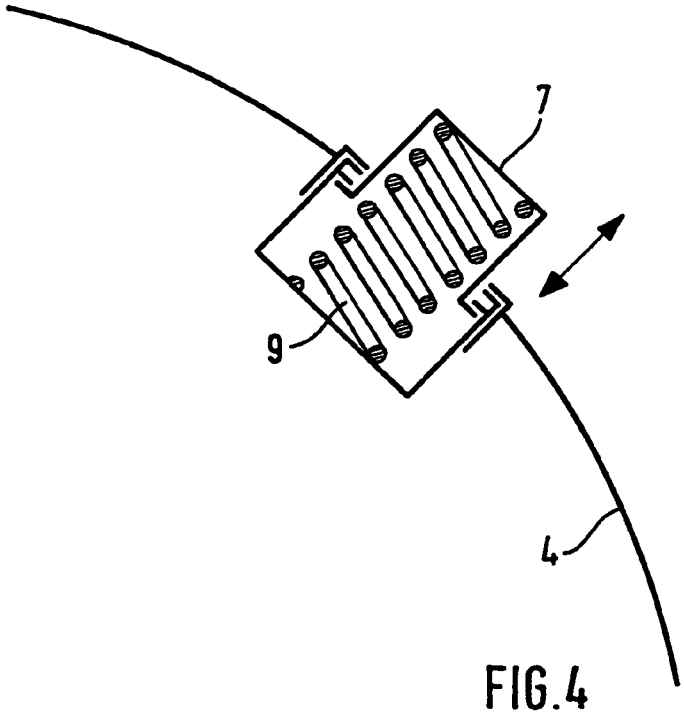
FIG. 4 shows an inventive sealing element in accordance with detail B in FIG. 3.

FIG. 4 shows detail B of FIG. 3 in an enlarged form. The sealing element 7 shown here is fastened to the surface of the screen 4. It consists of a pot-shaped element with a further pot-shaped element embedded therein. The two elements are urged apart by a spring 9 so that they abut with their edge areas.

FIG. 5 again shows the sealing element 7 in the depressed state. The sealing element 7 is urged against the pressure of the spring 9 under the level of the papermaking screen surface 4. The pressure is preferably produced by the take-off roll 5. That is, the sealing element 7 is urged downward upon contact with the take-off roll 5, thus in no way hindering the distortion-free removal of the paper web 10 by the pickup felt 6.

Figure 6:
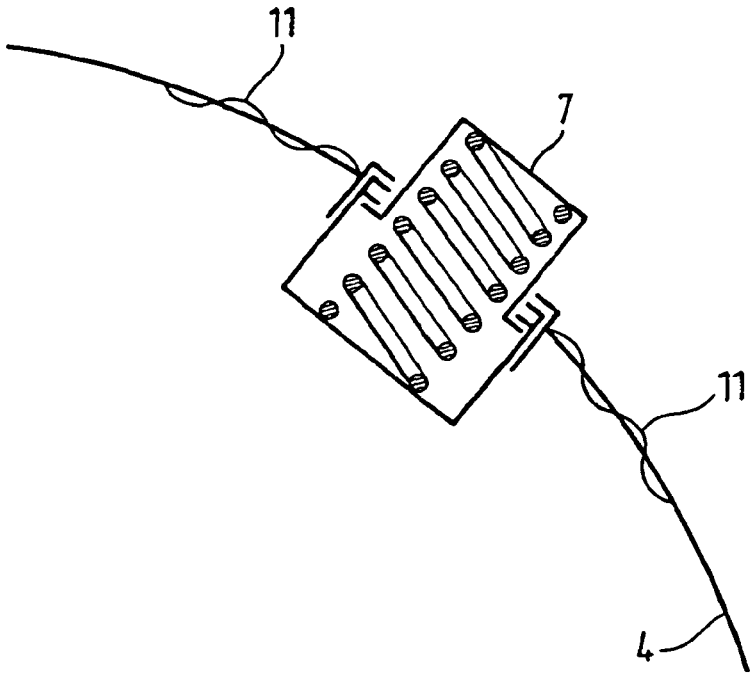
FIG. 6 shows detail B in accordance with FIG. 3 with additional screen embossing in the surroundings of the sealing element.

FIG. 6 shows a further embodiment of the inventive papermaking screen 4 with reference to an enlargement of detail B of FIG. 3. In this case the papermaking screen 4 additionally has a watermark embossing 11 in the surroundings of the sealing element 7. In the shown example the watermark embossing 11 is disposed symmetrically around the sealing element 7. However, any other embodiment of the watermark embossing 11 is also possible. The watermark embossing 11 causes the deposit of paper fibers in different thicknesses during sheet formation, so that the finished paper web is modulated in this area and shows the reflected/transmitted light effect typical of watermarks.

Figure 7:
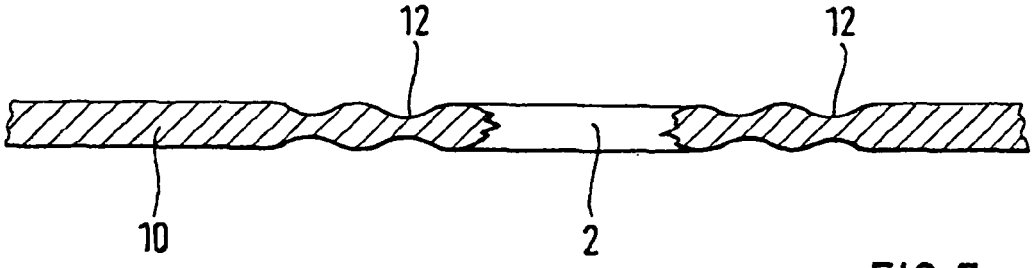
FIG. 7 shows a cross section through a security paper produced by the papermaking screen shown in FIG. 6.
Figure 8:
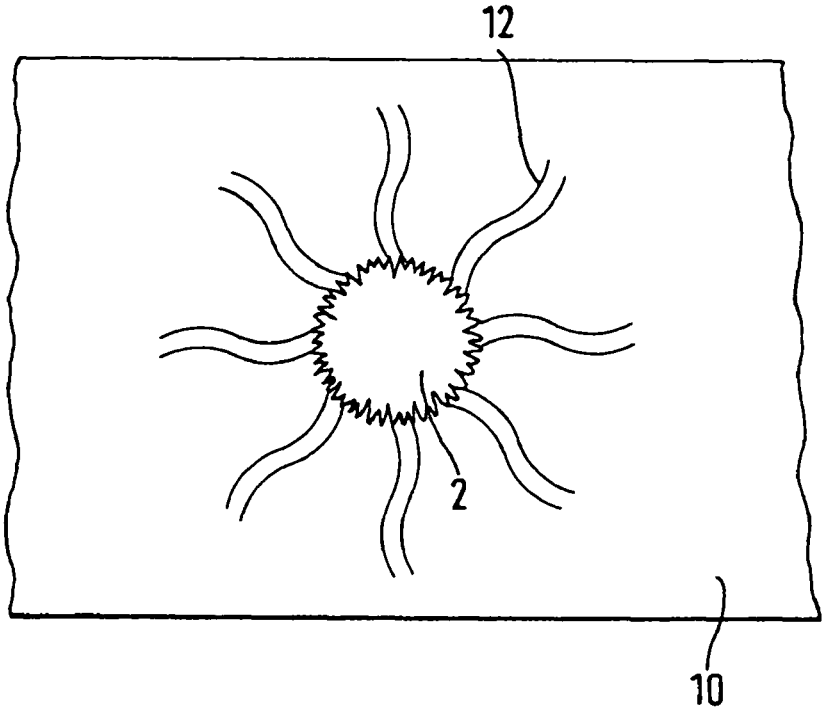
FIG. 8 shows a plan view of the security paper section shown in FIG. 7.

FIG. 7 shows a paper web 10 produced with the help of the papermaking screen 4 shown in FIG. 6. Said paper web 10 has an opening 2 produced by the sealing element 7. The modulated paper areas 12, however, were produced by the watermark embossing 11. Said paper areas hereinafter designated "the watermark 12" can be directly related meaningfully to the opening 2, or the opening 2 and the watermark 12 can together form a motif, as shown for example in a plan view in FIG. 8. The opening 2 has a circular outline form and is surrounded by a radial watermark 12, resulting in the motif of a sun.

Figure 9:
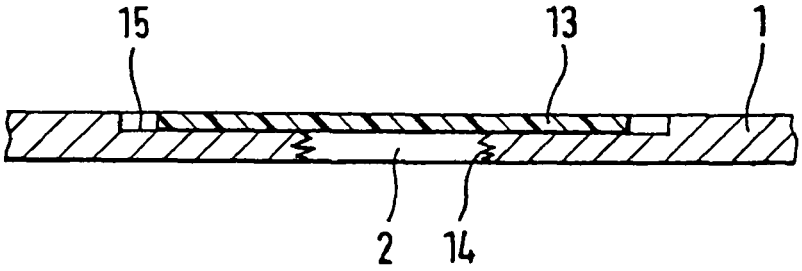
FIG. 9 shows a further embodiment of the inventive security element in cross section along line A-A in FIG. 1.

FIG. 9 shows a further embodiment of the value document 1 shown in FIG. 1 in cross section along line A-A. In this case the opening 2 is sealed by a security element 13 on one side. Said security element 13 is preferably disposed in a depression 15 surrounding the opening. Said depression 15 can be produced by subsequent calendering of the paper web 10, i.e. by compression of the paper fibers.

Alternatively, the depression 15 can also be produced by an actual reduction of the paper thickness in this area. This is most simply done directly during production of the paper web 10 by performing sheet formation thinner in said area through a corresponding formation of the screen. This can be done by corresponding embossings 16 in the papermaking screen 4.

Figure 5:
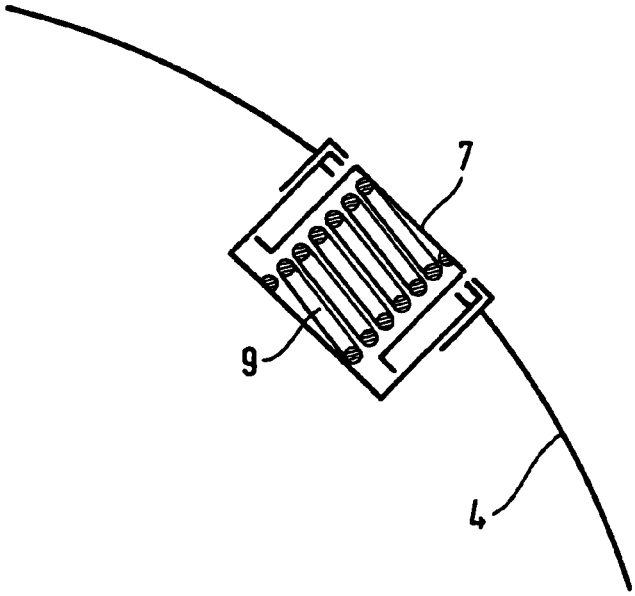
FIG. 5 shows an alternative embodiment of the sealing element.

The sealing element 7 shown in FIGS. 4 and 5 can be realized in a great variety of ways. It is thus likewise conceivable to realize it by a foamlike plug which is compressed by the take-off roll 5. This element is glued to the papermaking screen 4 and likewise prevents sheet formation in this area. However, it can also be realized by a pot-shaped, elastic element which is compressed by pressure and then returns to the original form.

The security element 13 can be of single- or multilayer form and has at least one paper or plastic layer. The security element 13 preferably has in the area of the opening 2 a relatively large transparent area which serves as copy protection, on the one hand, and makes the opening edge recognizable from both sides, on the other hand. Furthermore, the security element 13 can be provided with any desired security features.

Figure 10:
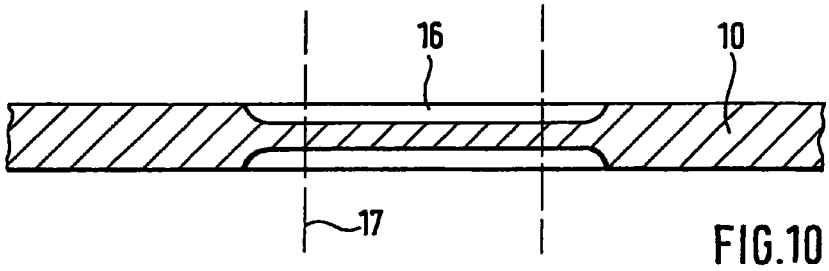
FIG. 10 shows a further embodiment of the inventive security paper in cross section.

FIG. 10 shows a further embodiment of the inventive security paper in cross section. The paper web 10 has an area 16 with a smaller paper thickness in comparison with the rest of the paper web. However, paper thickness is almost uniform throughout the area 16. This thin area 16 can be produced by corresponding screen embossing or freeness hindrance during production of the paper web 10. In said thinner area 16 the inventive opening 2 is subsequently provided. The edge contours 17 of the opening 2 are indicated by dashed lines in FIG. 10. The opening 2 is preferably produced in this embodiment by subsequent punching or cutting of the paper web in the area 16. It must at the same time be ensured that the area 16 protrudes beyond the opening 2 at least in a partial area to permit a corresponding check of the authenticity of the paper web 10 to be performed upon transmissive viewing.

Figure 11:
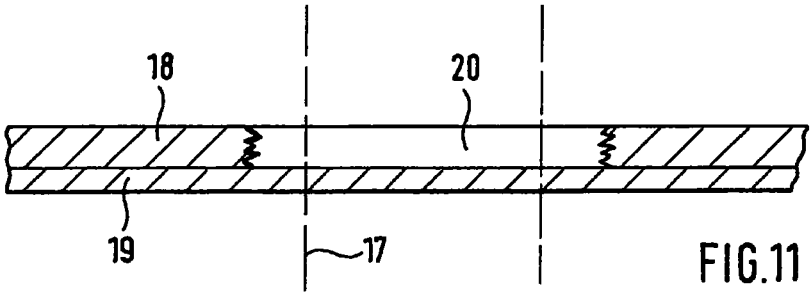
FIG. 11 shows a further embodiment of the inventive security paper in cross section.

FIG. 11 shows a further embodiment of the inventive security paper, whereby the security paper in this case consists of two paper layers 18, 19. The two paper layers 18, 19 are produced on separate cylinders and combined directly after removal from the papermaking screen and then further processed jointly. In the first paper web 18 a hole 20 is produced with the above-explained aids during sheet formation on the cylinder. When the two paper webs 18, 19 are combined, said hole 20 is sealed again on one side. After completion of the security paper the inventive opening 2 is provided in the second paper web 19. The edges 17 of the opening 2 are also shown by dashed lines in this figure. The opening is produced here by cutting or punching, whereby it must be ensured analogously to the embodiment shown in FIG. 10 that the edges 17 or cut edges of the opening 2 are located in the area of the hole 20.

Figure 12:
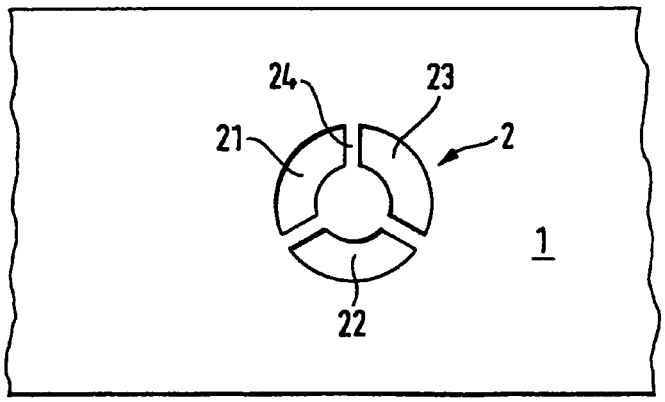
FIG. 12 shows a further embodiment of the inventive value document.

FIG. 12 shows a further embodiment of the inventive value document 1 in a plan view. The opening 2 is composed in this example of several partial openings 21, 22, 23 separated from each other by paper bars 24. Said partial openings 21, 22, 23 can be produced analogously to the above-described variants for the opening 2.

The invention claimed is:

1. A value document comprising a security paper, wherein the value document has a first exposed surface side and a second exposed surface side opposite the first surface side and further has at least one through opening extending unobstructed from the first surface side through to the second surface side and including an edge area defining the perimeter of the through opening, whereby the through opening is produced during formation of the security paper on a papermaking screen and the edge area of the through opening consists of paper fiber.

2. The value document according to claim 1, characterized in that the security paper has at least one watermark in the surroundings of the opening.

3. The value document according to claim 2, characterized in that the security paper has a smaller paper thickness in the area of the watermark.

4. The value document according to claim 2, characterized in that the opening and the surrounding watermark are meaningfully related or form a connected motif.

5. The value document according to claim 1, characterized in that the security paper has a predetermined paper thickness and an area with a smaller paper thickness in comparison with the predetermined paper thickness, and in that the opening is disposed in the area of smaller paper thickness and has dimensions which are smaller than those of the area of smaller paper thickness.

6. The value document according to claim 1, further including a security element disposed in an area surrounding the opening.

7. The value document according to claim 6, characterized in that the security paper has a depression surrounding the opening and having the security element disposed therein.

8. The value document according to claim 6, characterized in that the security element has at least one layer consisting of paper or plastic.

9. The value document according to claim 6, characterized in that the security element has at least one security feature.

10. The value document according to claim 9, characterized in that the security feature comprises a diffraction structure, a thin-film element, a polarizing filter or a print having at least one substance with optically variable, luminescent, electrically conductive or magnetic properties.

11. The value document according to claim 9, characterized in that the security feature and at least one watermark surrounding the opening are meaningfully related or form a connected motif.

12. The value document according to dam 6, characterized in that the security element is a label or an embossed foil element.

13. The value document according to claim 6, characterized in that at least one of the opening and the security element is circular, oval, rectangular, trapeziform or star-shaped.

14. The value document according to claim 6, characterized in that the security element is formed in a strip shape.

15. The value document according to claim 6, characterized in that the security element has at least one transparent area in the area of the opening.

16. The value document according to claim 1, wherein the papermaking screen is provided with at least one water-impermeable sealing element to produce the through opening.

* * * * *